US010794583B2

(12) United States Patent
Patterson et al.

(10) Patent No.: US 10,794,583 B2
(45) Date of Patent: Oct. 6, 2020

(54) FLOODLIGHT HEAT TRANSFER SYSTEM

(71) Applicant: Insight Lighting, Inc., Rio Rancho, NM (US)

(72) Inventors: Jaxon K. Patterson, Rio Rancho, NM (US); George Reekie, Bristol, RI (US); Rob Love, Oro-Medonte (CA)

(73) Assignee: INSIGHT LIGHTING, INC., Rio Rancho, NM (US)

( * ) Notice: Subject to any disclaimer, the term of this patent is extended or adjusted under 35 U.S.C. 154(b) by 208 days.

(21) Appl. No.: 15/957,033

(22) Filed: Apr. 19, 2018

(65) Prior Publication Data

US 2018/0306426 A1 Oct. 25, 2018

Related U.S. Application Data

(60) Provisional application No. 62/487,825, filed on Apr. 20, 2017.

(51) Int. Cl.

| | |
|---|---|
| ***F21V 29/507*** | (2015.01) |
| ***F21V 29/74*** | (2015.01) |
| ***F21V 29/83*** | (2015.01) |
| ***F21V 23/02*** | (2006.01) |
| ***F21V 21/30*** | (2006.01) |
| ***F21V 29/76*** | (2015.01) |
| ***F21V 29/75*** | (2015.01) |
| ***F21Y 115/10*** | (2016.01) |
| ***F21Y 105/10*** | (2016.01) |

(52) U.S. Cl.

CPC ..... *F21V 29/507* (2015.01); *F21V 21/30* (2013.01); *F21V 23/023* (2013.01); *F21V 29/74* (2015.01); *F21V 29/75* (2015.01); *F21V 29/763* (2015.01); *F21V 29/83* (2015.01); *F21Y 2105/10* (2016.08); *F21Y 2115/10* (2016.08)

(58) Field of Classification Search

CPC ..... F21V 29/507; F21V 29/74; F21V 29/75; F21V 29/763; F21V 29/83; F21V 21/30; F21V 23/023; F21Y 2105/10; F21Y 2115/10

USPC ..... 362/294

See application file for complete search history.

(56) References Cited

U.S. PATENT DOCUMENTS

| | | | | |
|---|---|---|---|---|
| 8,485,691 | B2 | 7/2013 | Hamel et al. | |
| 2012/0287613 | A1* | 11/2012 | Hamel | F21V 29/83 362/184 |
| 2016/0348861 | A1* | 12/2016 | Bailey | F21S 8/026 |

* cited by examiner

*Primary Examiner* — Cara E Rakowski
*Assistant Examiner* — Jessica M Apenteng
(74) *Attorney, Agent, or Firm* — Dennis F. Armijo; Rod D. Baker

(57) ABSTRACT

A Light Emitting Diode (LED) light fixture that provides high illumination such as that found for indoor and outdoor performance lighting. The LED fixture has a LED housing and a power supply housing that are configured to have a space between them when constructed for air flow. LED housing has two sets of cooling fins, a first set with a length from the face of the LED housing to the rear of the LED housing, and a second with a length from the face of the LED housing into a cut-out in the power supply housing. This cooling system provides for an efficient, compact, and esthetically pleasing fixture.

17 Claims, 11 Drawing Sheets

FLOODLIGHT HEAT TRANSFER SYSTEM

The present application claims priority to U.S. Provisional Application No. 62/487,825 entitled FLOODLIGHT HEAT TRANSFER SYSTEM filed Apr. 20, 2017, and the specification of which is incorporated herein by reference.

BACKGROUND OF THE INVENTION

Field of the Invention (Technical Field)

The presently claimed invention relates to lighting fixtures and more specifically to high powered Light Emitting Diode (LED) indoor and outdoor lighting fixtures.

Background Art

Improvements in LED technology have resulted in the evolution of "high powered" LEDs. Lighting fixtures include LED arrays made of high powered LEDs have proven practical and suitable for indoor and outdoor performance lighting. Performance LED array lighting fixtures are advantageous over traditional and conventional lighting device's by delivering comparable illumination outputs at significantly lower power consumption, which results in energy savings.

New LED's have also been advantageous in providing simple and flexible control of the color, or color temperature of the lighting fixture output. That is, LED lighting fixtures may now include a variety of combinations of red, green, blue, as well as white LEDs having different color temperatures. The color or color temperature output of these LED arrays may be further controlled by using dimming controls of the LEDs on the array so that the illumination outputs of the individual LEDs in the array combine to provide the desired output of light.

The issue with LEDs in general, and now exacerbated with higher powered LEDs being used in lighting fixtures, is the heat generated by the LEDs on the array. It is well known that heat adversely affects all solid-state electronics, in this case a lighting unit. LED's have a maximum allowable operating temperature of the diode, known as junction temperature, when the maximum allowable heat is neared or exceeded. This results in shortened use or life of the components and an increased failure rate of any components in proximity to this generated heat. These components can include the power supply, control circuitry, and possibly the LEDs themselves.

Prior art attempts to solve this problem have been met with limited success. An example of one of these devices in found in U.S. Pat. No. 8,485,691 B2 to Hamel, whereby the heat generated from the LEDs is directed to a chimney and exhausted away from the lighting device.

This problem is compounded by the lighting industry's desire for LED lighting fixtures to be as small as possible, and fixtures that are esthetically pleasing in appearance. Such considerations often result in fixtures having poor heat transfer and dissipation characteristics with consequently high interior temperatures. The present design invention provides a solution to these and related problems of the prior art.

SUMMARY OF THE INVENTION (DISCLOSURE OF THE INVENTION)

The claimed invention relates to the use of high output light emitting diode technology, providing up to 15,000 lumens or greater, a total illumination of up to approximately 200 watts of power dissipation. This causes heating problems which require heat dissipation to prevent damage or reduced functionality of the components in the lighting fixture. The presently claimed lighting fixture invention designed for Light Emitting Diode (LED) technology is composed of two main sub-assemblies, a LED sub-housing assembly and a power supply sub-assembly.

Included in the LED housing sub-assembly is a glass lens, gasket, and a face ring seal inside this housing, and a single Printed Circuit Board Assembly (PCBA) mounted to the inner LED heat sink housing. The other section is a minimal cavity power supply sub-assembly housing having a cover and sealing gasket in which a power supply and controls are mounted.

The backside surface of the LED sub-assembly housing includes fins and a heat transfer element. The LED heat sink housing has numerous heat dissipating fins that protrude from the back of the housing. In addition, in specific areas these deep-set fins continue to protrude.

When assembled to the power supply housing, which has an intentional cutout area to accommodate the deep-set fins of the LED housing, these fins extend until they are just slightly below, but almost flush with, the power supply housing's outer exterior surface. When fully assembled, the rear surface of the LED housing's lower fins is spaced apart from the front cover surface of the power supply housing. This defines an air flow space in between the two separate sub-assemblies, as combining these sub-assembly surfaces would compound the heat generated by the LED and power supply sub-assemblies.

During operation the ambient air flows through the fins from bottom to top, thus exiting the fixture. The additional extended fins allow more surface area for dissipating the main source of heat from the LED's. The cut-out area of the power supply housing also allows more surface area for dissipating heat, and passing that heat through to the back of the fixture.

The air flow is dependent on the mounted orientation of the fixture; for this discussion the fixture is mounted up, i.e., the LED surface is 90 degrees to the mounting surface as shown in FIG. 2A. Depending on the final mounting orientation of the fixture, the power supply housing cut out also acts as a heat dissipating chamber.

The preferred method and structure for heat dissipation involve deep-set fins that pass through the light fixture housings. The method is for dissipating heat directly from the major heat source, the array, and through the depth of the fixture. The deep-set heat sink fins on the LED housing create a direct thermal path to the exterior of the fixture. The power supply housing in this pass through is defined by the outer shape of the spot light, which is round in this case, and the maximum allowable surface area needed to house the power supply, components, and features offered in the fixture. All other material of the power supply housing is removed, allowing for the deep-set fins of the LED array housing and the array's subsequent heat to pass through the power supply housing, and opening to the outside ambient air around the assembly.

This deep-set fin concept can be used in a fixture of any shape and size. Other shapes, for example, such as square, rectangular, or polygonal are possible, and fall within the scope of the presently claimed invention.

A segmented, replaceable, sub-assembly component system is intentional in the design because it allows for flexibility in adding, changing, upgrading or correcting errors without major reconstruction to the lighting fixture. This results in a "plug and play" design.

By design the LED array housing, glass, sealing gasket, and face ring are individual components of the entire assembly, capable of containing various versions of LED arrays or solid-state circuitry offered in the fixture.

Also, by design the power supply housing, sealing gasket, and cover are intended to be individual components of the entire assembly capable of containing various versions of power supplies or control components offered in the fixture.

The segmented nature of this design allows having a replaceable, serviceable and/or upgradeable LED housing assembly, and separate but connected power supply housing assembly that is also replaceable, serviceable, and/or upgradeable.

A primary object of the presently claimed invention is to dissipate heat generated by the components in the lighting fixture effectively and efficiently.

Other objects, advantages and novel features, and further scope of applicability of the presently claimed invention will be set forth in part in the detailed description to follow, taken in conjunction with the accompanying drawings, and in part will become apparent to those skilled in the art upon examination of the following, or may be learned by practice of the presently claimed invention. The objects and advantages of the presently claimed invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the presently claimed invention and, together with the description, serve to explain the principles of the presently claimed invention. The drawings are only for the purpose of illustrating a preferred embodiment of the presently claimed invention and are not to be construed as limiting the presently claimed invention. In the drawings:

Figure 1A:
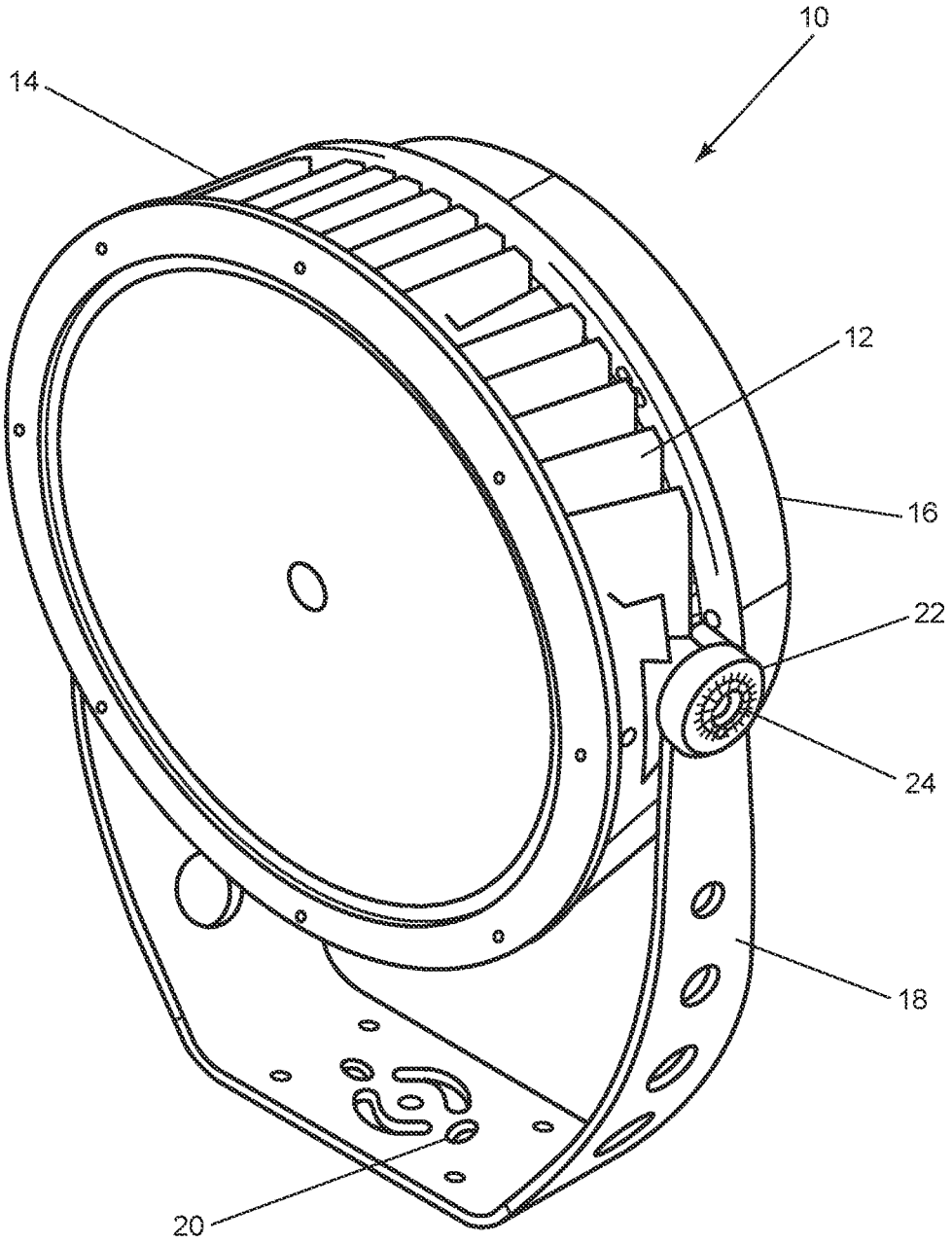
FIG. 1A is front isometric perspective view of a fully assembled floodlight lighting unit.
Figure 1B:
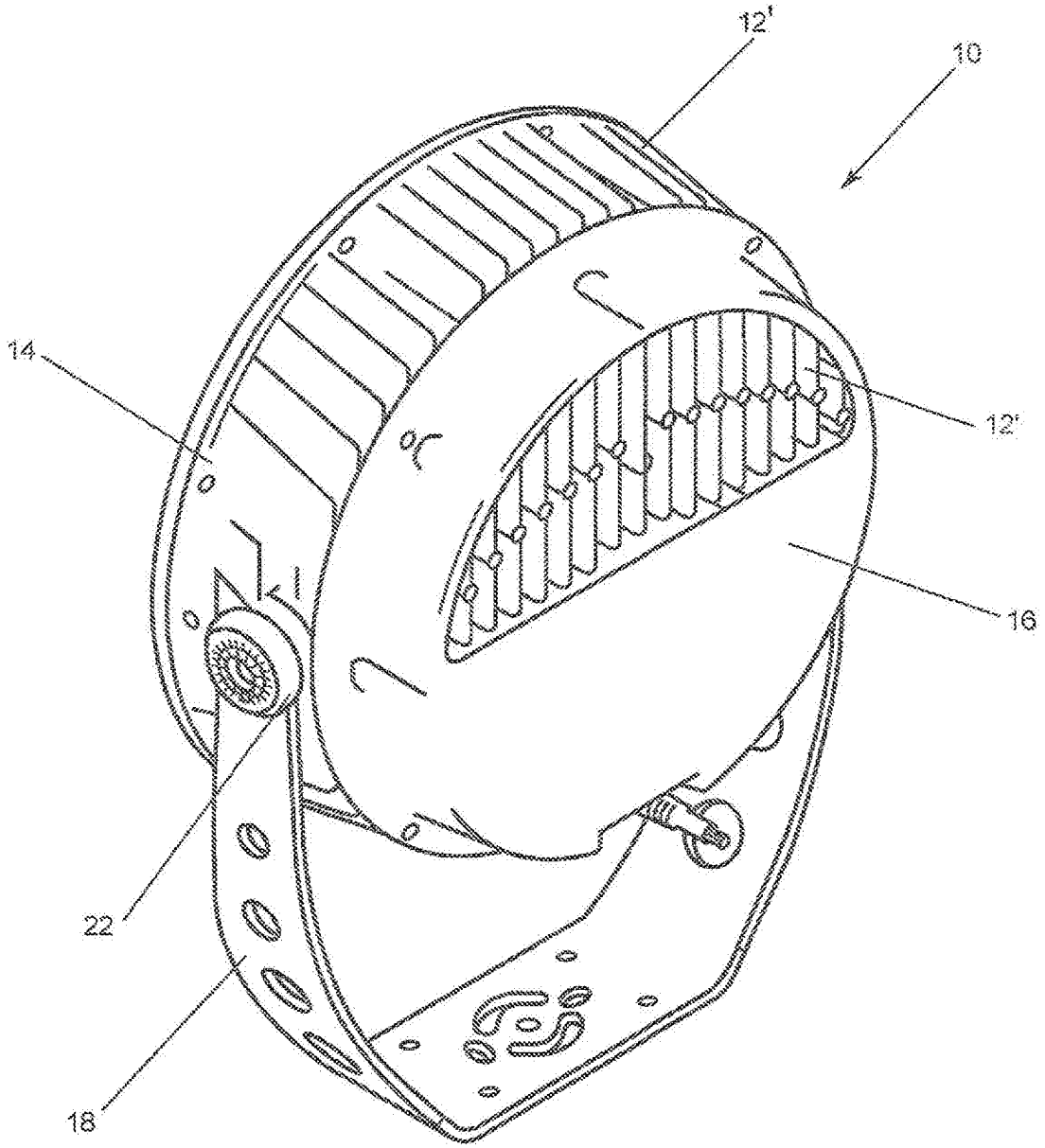
FIG. 1B is a rear view of the embodiment of FIG. 1A.
Figure 2A:
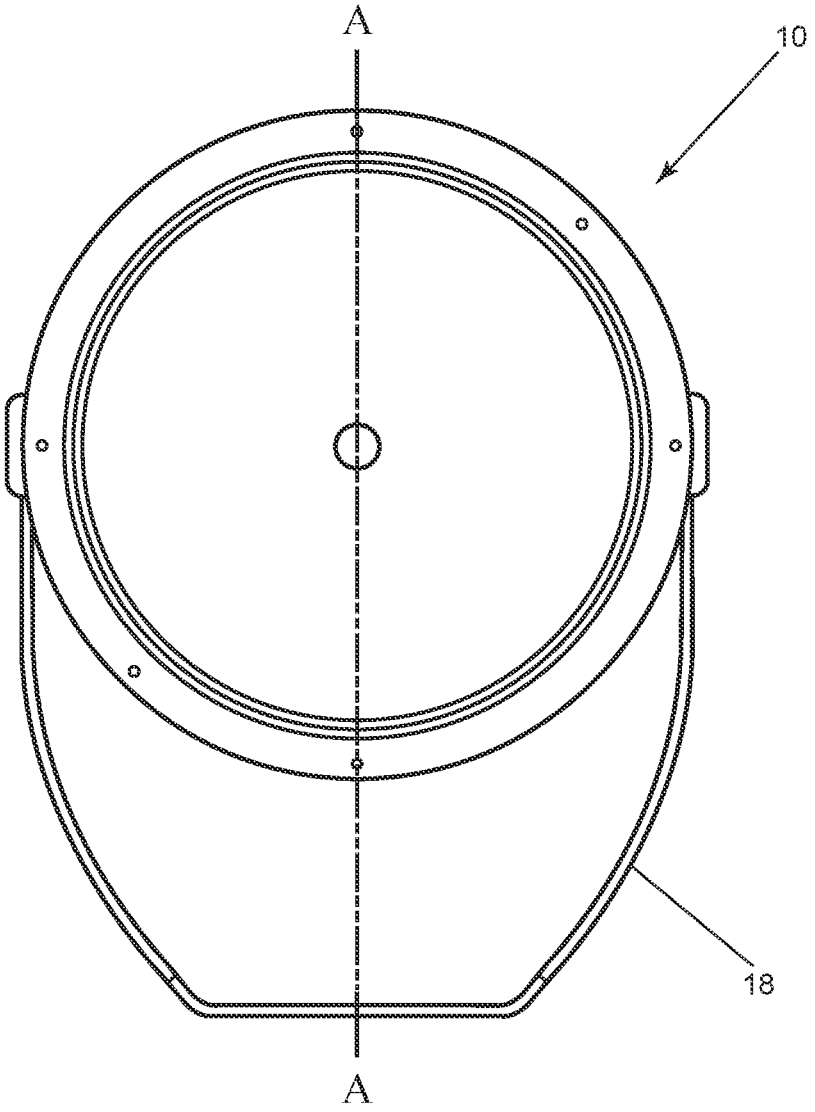
FIG. 2A is a front view of the embodiment of FIG. 1A.
Figure 2B:
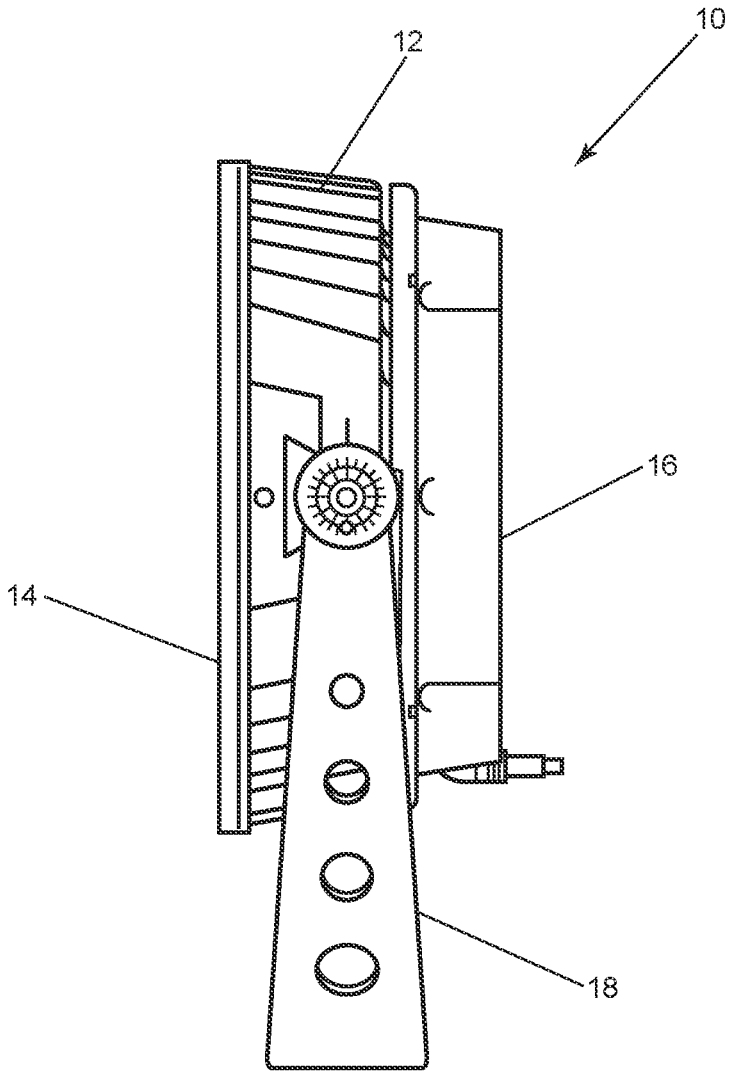
FIG. 2B is a side view of the embodiment of FIG. 1A.
Figure 2C:
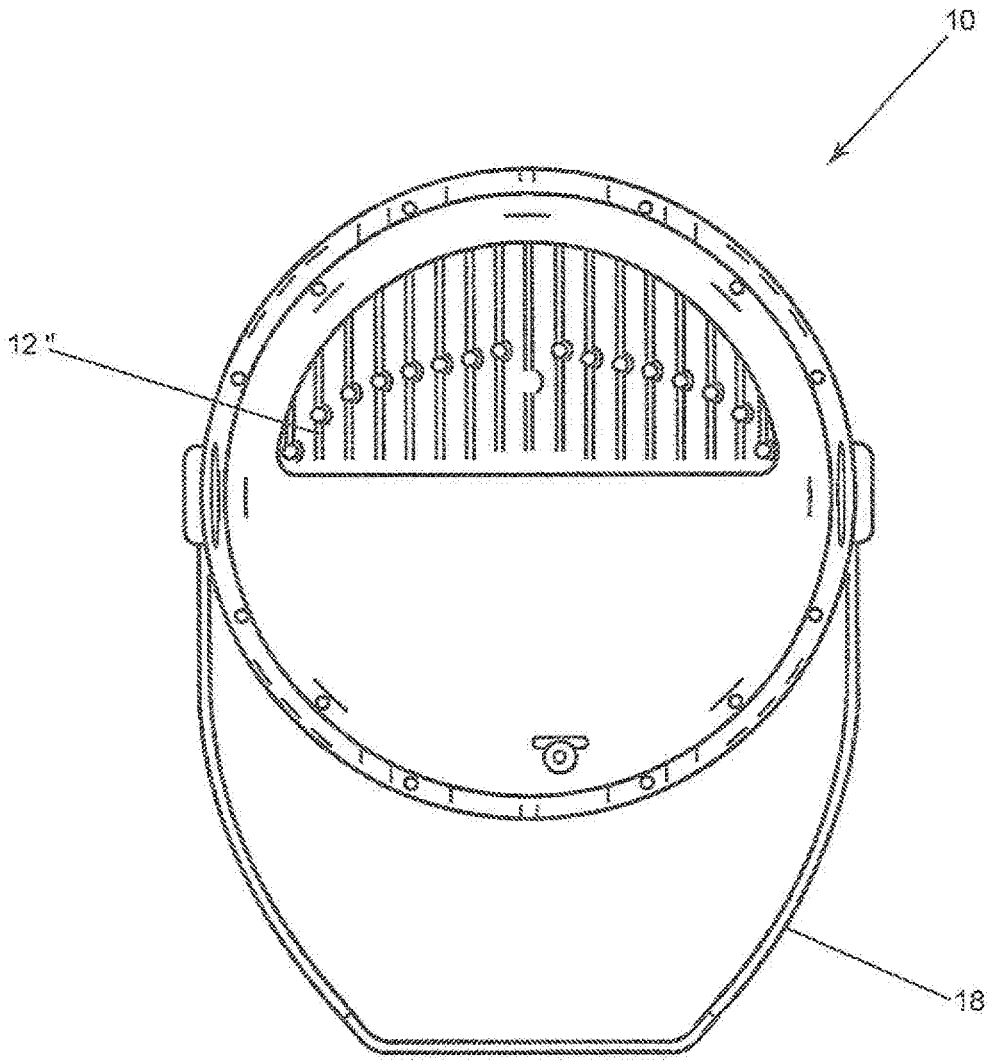
FIG. 2C is a rear view of the embodiment of FIG. 1A.
Figure 2D:
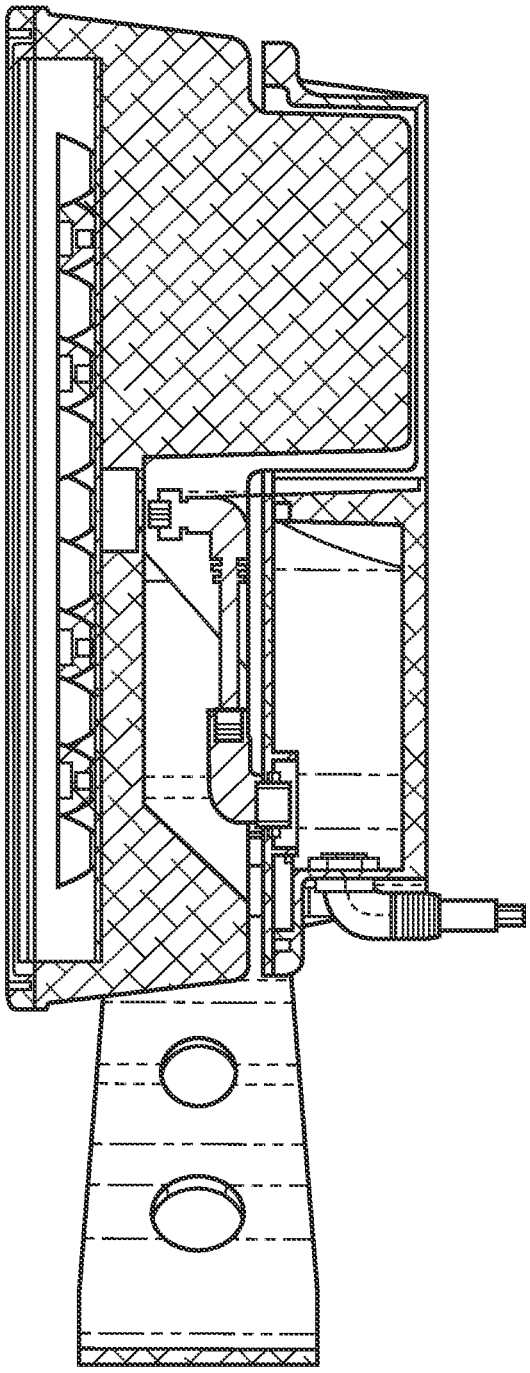
FIG. 2D is a cut out view along A-A of FIG. 2A.

DESCRIPTION OF THE PREFERRED EMBODIMENTS (BEST MODES FOR CARRYING OUT THE INVENTION)

FIGS. 1-7 show the preferred embodiment of the claimed invention. FIGS. 1A and 1B are front and backside isometric views, respectively, are representations of a seventeen inch (17) LED light fixture 10. This disclosure is intended to include a plurality of different sized LED light fixtures that operate and are configured similarly. LED light fixture 10 has two distinct sets of fins 12 that both originate in LED housing 14. LED housing 14 and power supply housing 16 are preferably made of A380 Cast Aluminum, typically provided with a powder coat finish. FIG. 2A is a front view of the embodiment of FIG. 1A, and FIG. 2B is a side view of the same. FIG. 2C is a rear view of the LED light fixture 10. FIG. 2D is a cut out view along A-A of FIG. 2C. There are two sets of fins 12 in the preferred embodiment. Short fins 12' are defined as fins that encompass the entire circumference of LED housing 14 and begin at the face of LED housing 30 and extend to the face of power supply housing 32. Deep set fins 12" are defined as a plurality of fins that begin at the face of LED housing 30 and extend into the opening of power supply housing 28. In these views, deep set fins 12" can be seen protruding into the opening of power supply housing 28. Deep set fins 12" do not make contact with power supply housing 28 to allow for air flow, which is discussed below. Deep set fins 12" preferably extend to the rear surface of power supply housing 34, as shown. Included in LED light fixture 10 is mounting brace 18 for affixing to a preferred surface such as a pole or the like. Included on mounting brace 18 are a plurality of apertures 20 for accommodating screw, bolts and other affixing means. Mounting brace 18 is secured to LED housing 14 via trunnion mount 22. Markings on trunnion mount 24 can indicate different angles for pointing LED light fixture 10 in the desired direction.

Figures 3A, 3B, 3C:
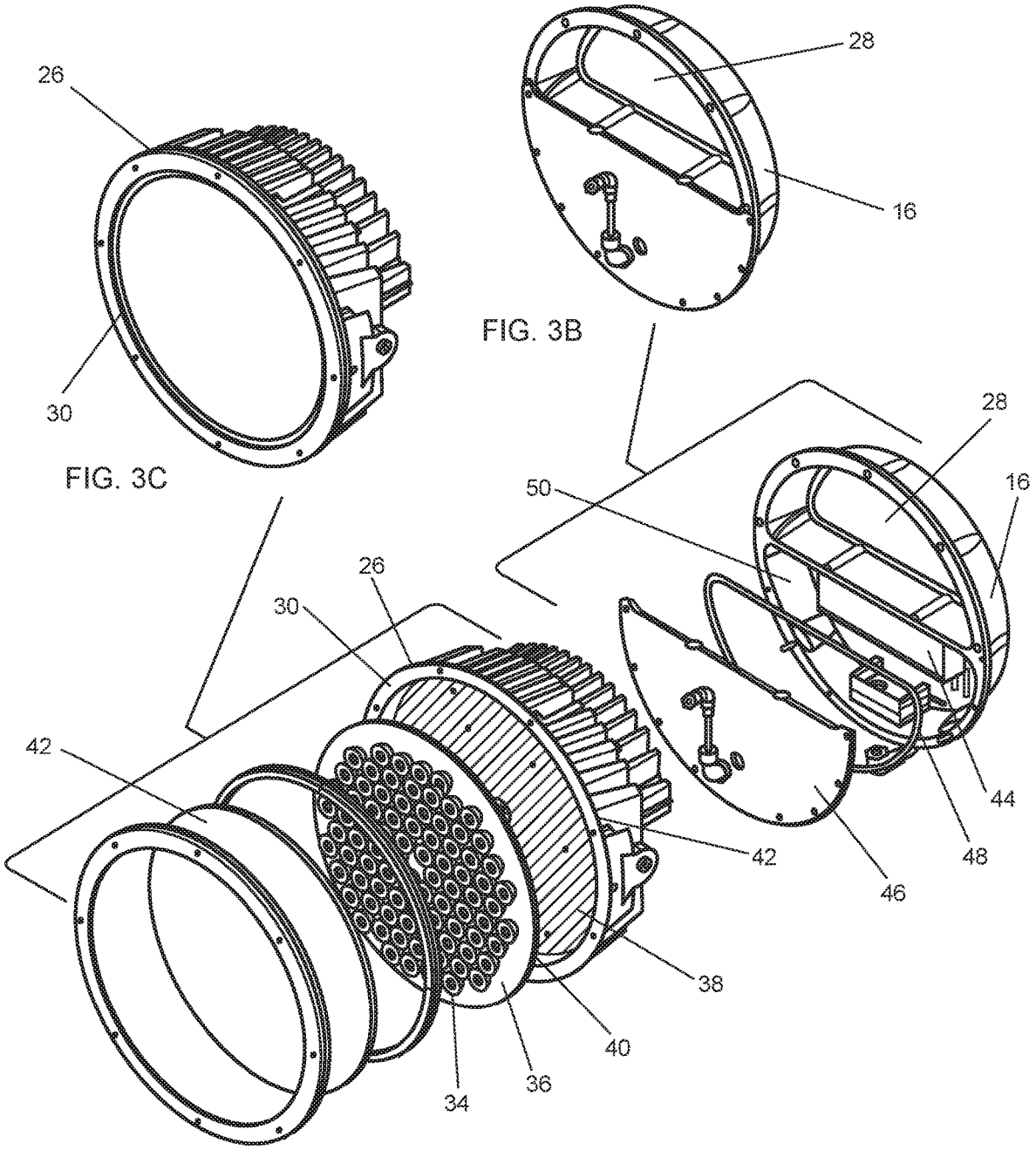
FIG. 3A is an exploded isometric view of the LED housing and power supply housing parts.
FIG. 3B is an isometric view of the power supply housing sub-assembly.
FIG. 3C is an isometric view of the LED housing sub-assembly.
Figure 4:
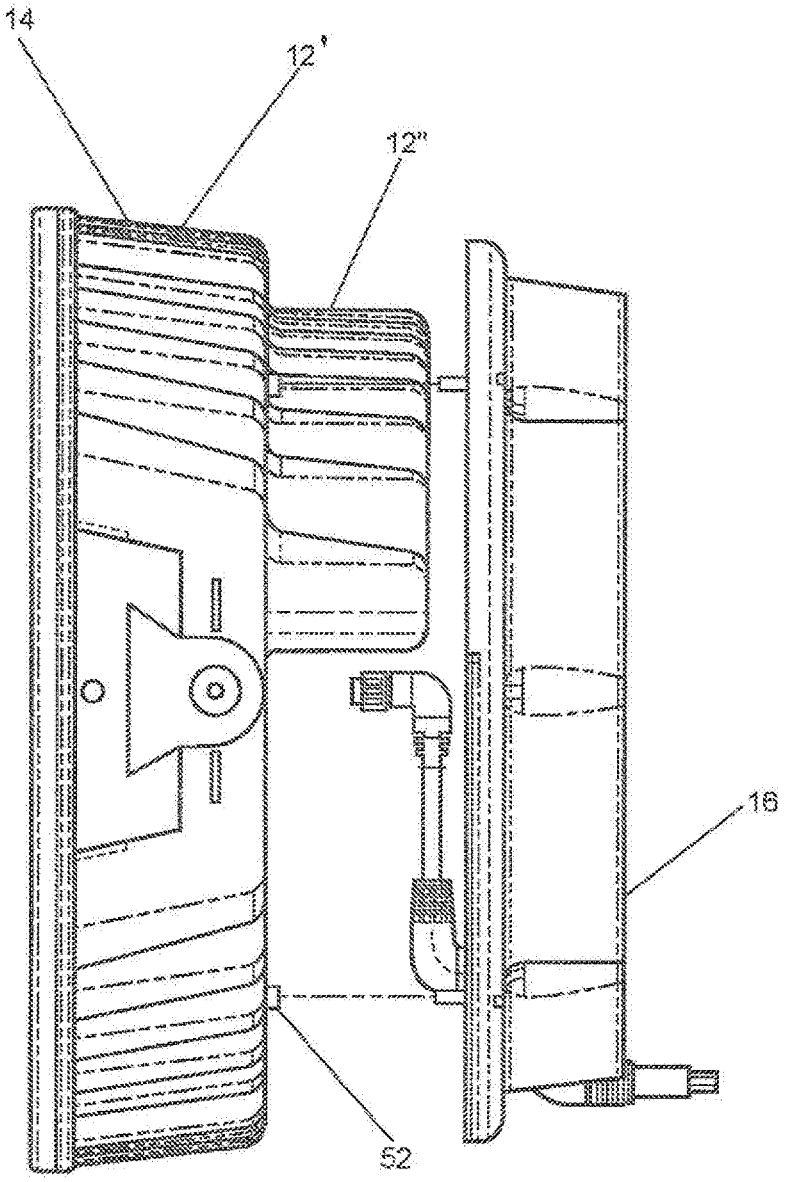
FIG. 4 is a side view, showing the separated, interchangeable components, components: the LED housing, and the power supply housing of the preferred embodiment of the lighting fixture.

FIGS. 3A-3C show the preferred components and configuration of led light fixture 10. Components affixed to LED housing 14 are Light Emitting Diodes (LEDs) 34 which are mounted on a single Printed Circuit Board Assembly (PCBA) 36. LEDs 34 are preselected by a user to provide the preferred color combination and illumination. PCBA 36 is mounted on the forward-facing surface of LED housing 30, compartment or deck 38. To create a thermally conductive path between back surface of the PCBA 40, and face of LED housing 30, a thin layer of thermally conductive grease (not shown) is applied to both surfaces. PCBA 36 is secured to LED housing 14 with screws, or other well-known attaching means (not shown). Opposite of deck 38 mounting surface are fins 12, the main heat transfer element, which protrude in a uniform thickness across entire backside of the LED housing 42, then specific areas of the fins (deep set fins 12") continue to protrude into the opening in power supply housing 28 as part of LED housing 14. Completing LED housing 14 is a disk of tempered, soda lime glass 42 at a thickness of approximately 4 mm, which is surrounded by an approved SIL-100 molded silicone gasket 44, which is then sandwiched to the front of LED housing 14 using screws or other well-known attaching means.

Referring again to FIGS. 3A-3C, are the components and configuration of the preferred power supply housing 16. The design creates a minimized sealed component compartment in power supply housing 16 for the power supply 44, AC input cable, and control components (not shown). The configuration contains cover 46 and IP67 rated gasket 48 affixed to power supply housing 16. Pursuant to the International Electrotechnical Commission, the IP stands for Ingress Protection (IP), the first number following the letters is the solids protection rating, and the second number represents the liquid protection rating. Note, the cut out portion of cover 46 and gasket 48 allows for deep set fins 12" to protrude into opening 28. Thus, to allow for deep set fins 12" to operate efficiently the sealed compartment 50 is minimized, leaving approximately 50% of power supply housing 16 material omitted, creating opening 28, which allows deep-set fins 12" to protrude up to this opening 28. When fully assembled, deep set fins 12" affixed to LED housing 14, by design, do not touch power supply housing 16. The only components making contact with LED housing 14 and power supply housing 16 are four (4) short bosses 52 designed into LED housing 14 used to secure the two main sub-assemblies together. Short bosses also provide space 58 between LED housing 14 and power supply housing 16 for cooling purposes.

Figure 5:
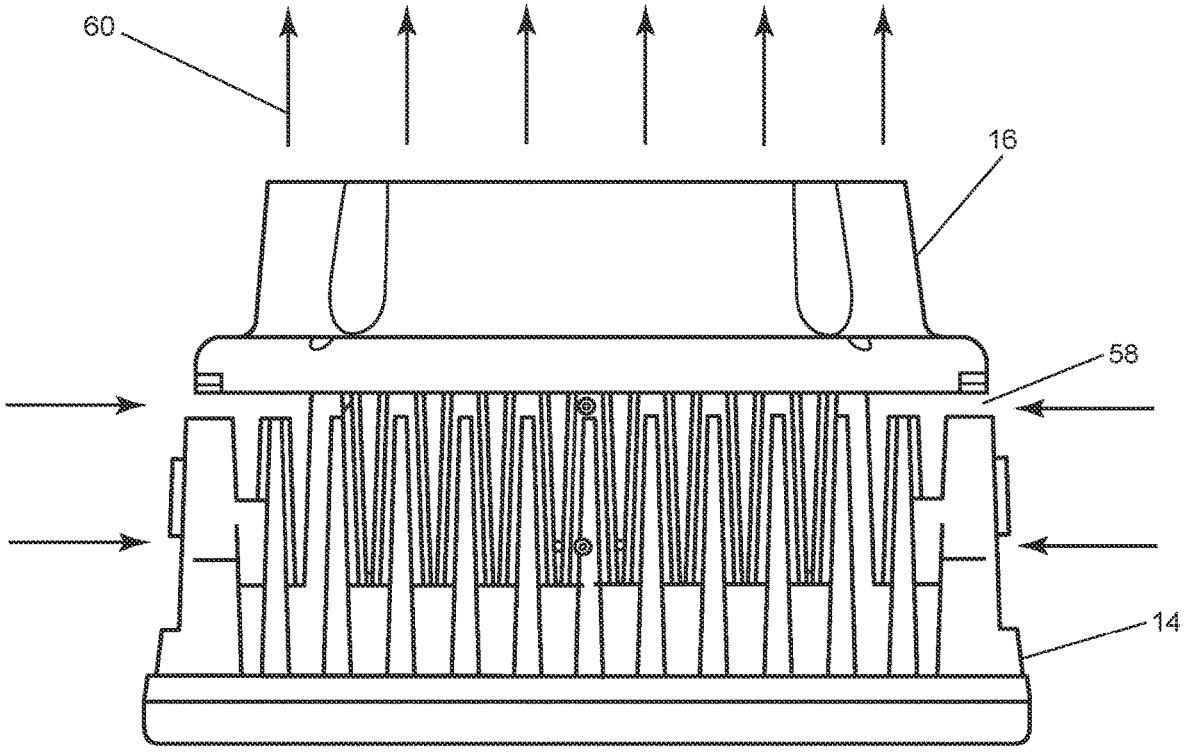
FIG. 5 is a side view of the preferred embodiment showing the air flow to and from the lighting fixture positioned for downward illumination.

As shown in FIG. 5, the surface of the power supply housing 16 is spaced away from the rear side fins on the LED housing 14. This space 58 is important to let air flow freely between the two separate assemblies and not combine or compound the heat generated from the two separate components.

The main heat sources in the LED light fixture 10 are the PCBA 36 and power supply 44. The heat produced by PCBA 36 conducts through LED housing 14 in all directions and is dissipated through LED housing 14 and deep-set fins 12". The generated heat moves up and through the fins 12 and exhausts 54 in all directions, including through deep-set fins 12" that protrude through power supply housing 16 to the rear of the unit.

The heated surfaces contact the ambient air around and inside gaps in fins 12, 12', and fixture housing 14 creating natural convection. Thus, the heated surfaces pass the higher temperature air to the ambient air, which helps in cooling LED light fixture 10. The fin 12 configuration as disclosed is effective in any mounting orientation, up down or vertical as shown.

Figure 6:
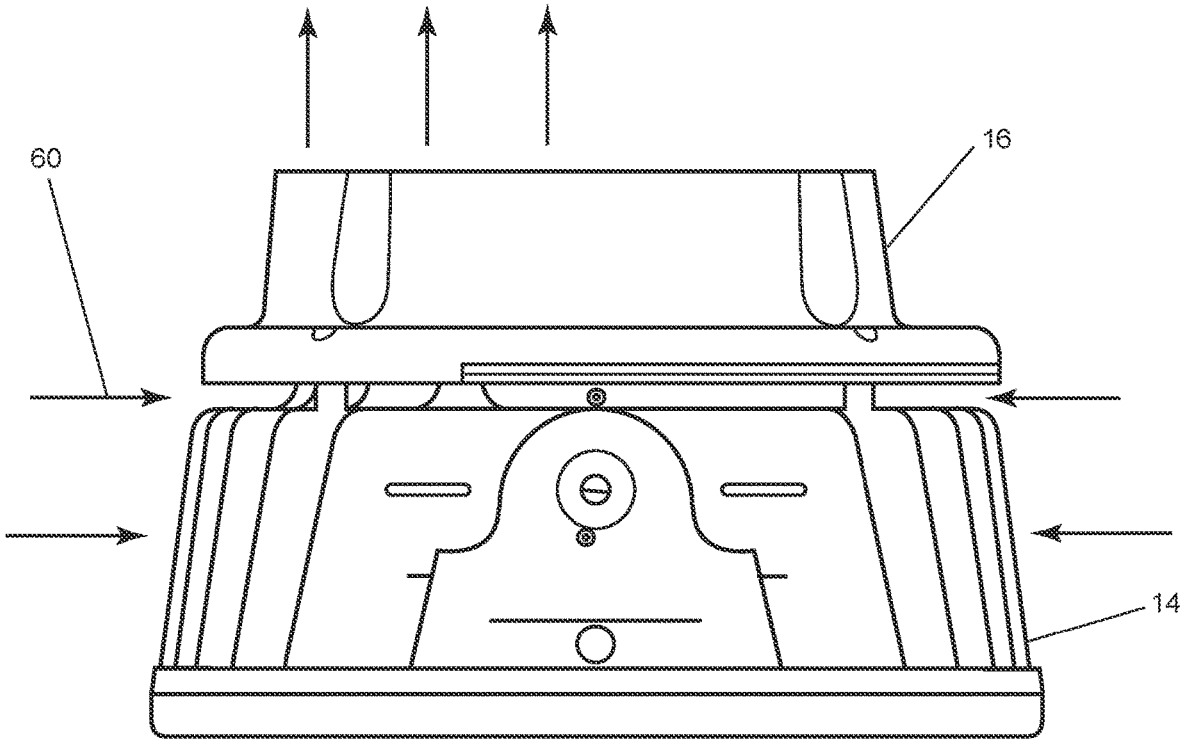
FIG. 6 is another side view of the embodiment of FIG. 5.
Figure 7:
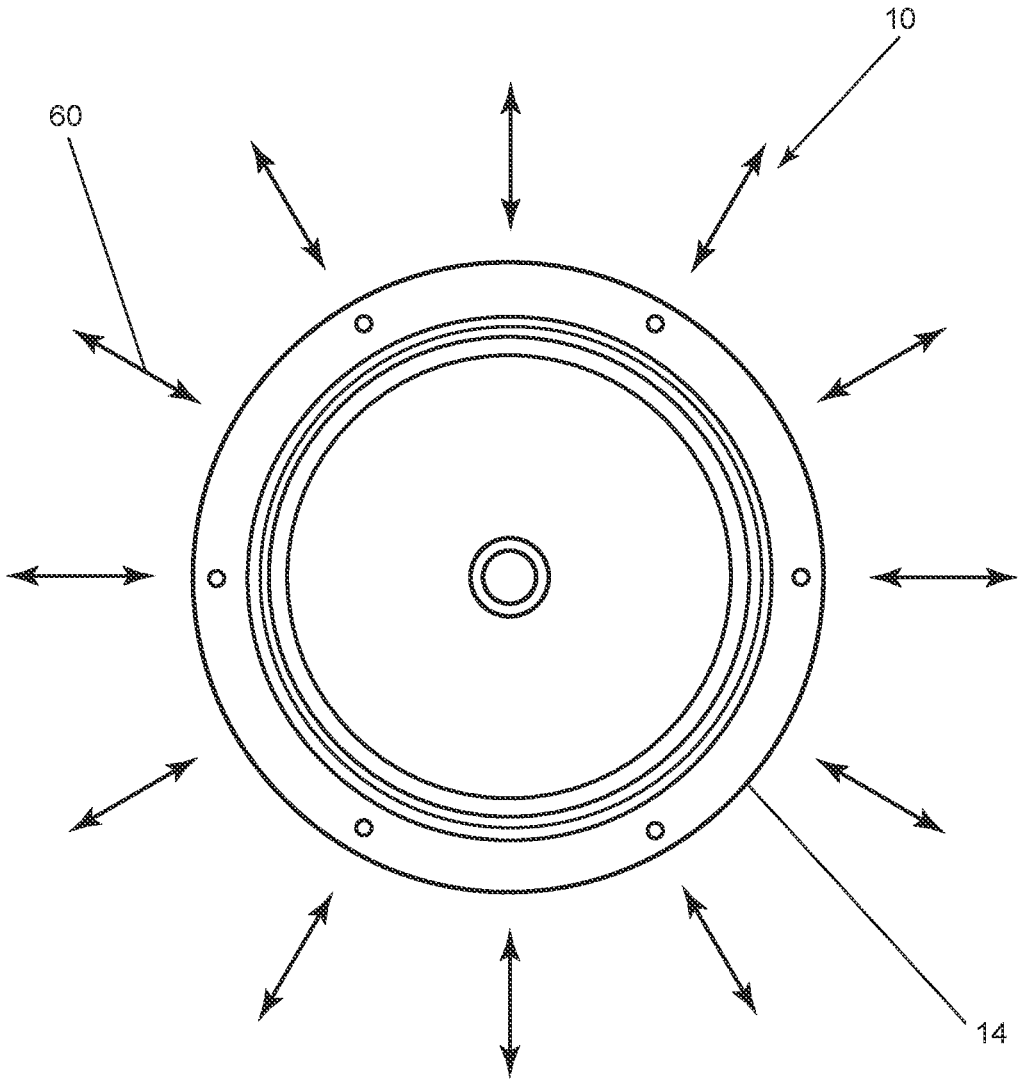
FIG. 7 is a bottom view of the embodiment of FIG. 5.

FIGS. 5, 6, and 7 show the air flow and cooling method for the preferred LED light fixture 10. FIG. 5 is a side view of LED light fixture 10 positioned for downward illumination. Airflow 60 is depicted as arrows that flows through fins 12 and airspace 68. LED light fixture 10 includes LED housing 14, which rotates and projects the light in any preferred direction. For this discussion LED housing 14 is shown facing downwards. Part of LED housing 14 is an integral heat transfer element, fins 12, which are cast as part of LED housing 14 and are configured to draw heat away from internal lighting electronics and dissipate into ambient air.

LED light fixture also includes a separate power supply housing 16 positioned behind LED array housing 14, and attached directly to LED housing 14, but is spaced apart 58 from LED array housing 14.

Airflow space 58 is defined between the rear surface and the opposing front surface of the two separate housings when mated. LED array housing 14 includes extended fins 12 located so that deep-set fins 12" extend and pass through power supply housing 16. Power supply housing 16 includes an offset located pass through or opening 28 extending through power supply housing 16 to accommodate the deep-set fins 12".

When positioned for downward illumination as shown, the heat transfer element heats air within the airflow space, creating an upward draft 60 through power supply housing pass through 28, as shown. Upward draft 60 draws cooler ambient air laterally into the airflow space from all sides, which results in continual cooling loop of LED light fixture 10.

Although the claimed presently claimed invention has been described in detail with particular reference to these preferred embodiments, other embodiments can achieve the same results. Variations and modifications of the presently claimed invention will be obvious to those skilled in the art and it is intended to cover in all such modifications and equivalents. The entire disclosures of all references, applications, patents, and publications cited above, are hereby incorporated by reference.

What is claimed is:

1. A Light Emitting Diode (LED) light fixture comprising:

a LED housing, comprising a plurality of cooling fins, the plurality of cooling fins comprising a first set of fins that originate at a face of the LED housing comprising a first predetermined length and a second set of fins that originate at the face of the LED housing comprising a second predetermined length, wherein the second predetermined length is longer than the first predetermined length;

a power supply housing, comprising an opening for the second set of fins; and a space between the LED housing and the power supply housing.

2. The Light Emitting Diode (LED) light fixture of claim 1 wherein the plurality of cooling fins are configured to transfer dissipated heat away from the LED housing.

3. The Light Emitting Diode (LED) light fixture of claim 1 wherein the first set of fins are configured to encompass an entire circumference of the LED housing.

4. The Light Emitting Diode (LED) light fixture of claim 1 wherein the first set of fins are configured to dissipate heat generated by the LED housing to an area surrounding an outside of the fixture and the space.

5. The Light Emitting Diode (LED) light fixture of claim 1 wherein the power supply housing comprises a minimum surface area for a power supply and related components, a remaining surface area comprising the opening.

6. The Light Emitting Diode (LED) light fixture of claim 1 wherein the power supply housing comprises a back panel comprising a surrounding ring around the second set of fins.

7. The Light Emitting Diode (LED) light fixture of claim 1 wherein the second set of fins are configured to create a direct thermal path through the space and to an exterior of the Light Emitting Diode (LED) light fixture.

8. The Light Emitting Diode (LED) light fixture of claim 1 wherein the second set of fins do not make contact with the power supply housing to allow for air flow between the LED housing and the power supply housing.

9. The Light Emitting Diode (LED) light fixture of claim 1 wherein components in the light fixture comprise a segmented, replaceable, sub-assembly component system.

10. The Light Emitting Diode (LED) light fixture of claim 1 wherein the power supply housing comprises a moisture proof enclosure.

11. A method of cooling a Light Emitting Diode (LED) light fixture, the method comprising the steps of:

providing a LED housing, comprising a plurality of cooling fins, the plurality of cooling fins comprising a first set of fins that originate at a face of the LED housing comprising a first predetermined length and a second set of fins that originate at the face of the LED housing comprising a second predetermined length, wherein the second predetermined length is longer than the first predetermined length;

drawing ambient air into a power supply housing through an opening containing the second set of fins; and circulating the ambient air through a space between the LED housing and the power supply housing.

12. The method of claim 11 comprising the step of transferring dissipated heat by the plurality of cooling fins away from the LED housing.

13. The method of claim 11 comprising the step of dissipating heat generated by the LED housing by the first set of fins to an area surrounding an outside of the fixture and the space.

14. The method of claim 11 wherein the step of providing an LED housing comprises providing the power supply housing with a minimum surface area for a power supply and related components, a remaining surface area comprising the opening.

15. The method of claim 11 comprising the step of dissipating air from the LED housing and power supply housing via a back panel in the power supply housing comprising a surrounding ring around the second set of fins.

16. The method of claim 11 comprising the step of creating a direct thermal path by the second set of fins through the space and to an exterior of the Light Emitting Diode (LED) light fixture.

17. The method of claim 11 comprising the step of flowing air through openings between the second set of fins and the power supply housing.

* * * * *